US008692730B2

(12) United States Patent
Shimizu et al.

(10) Patent No.: US 8,692,730 B2
(45) Date of Patent: Apr. 8, 2014

(54) MOBILE COMMUNICATION BASE STATION ANTENNA

(75) Inventors: Takayuki Shimizu, Hitachi (JP); Shinsuke Murano, Kasama (JP); Tomoyuki Ogawa, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 224 days.

(21) Appl. No.: 12/659,256

(22) Filed: Mar. 2, 2010

(65) Prior Publication Data

US 2010/0225552 A1 Sep. 9, 2010

(30) Foreign Application Priority Data

Mar. 3, 2009 (JP) ..... 2009-049764

(51) Int. Cl.
*H01Q 3/00* (2006.01)

(52) U.S. Cl.
USPC ..... 343/758

(58) Field of Classification Search
USPC ..... 343/758, 702, 797, 844, 853
See application file for complete search history.

(56) References Cited

U.S. PATENT DOCUMENTS

| | | | | |
|---|---|---|---|---|
| 5,686,926 | A | 11/1997 | Kijima et al. | |
| 5,923,296 | A | 7/1999 | Sanzgiri et al. | |
| 6,005,516 | A | 12/1999 | Reudink et al. | |
| 6,067,053 | A | 5/2000 | Runyon et al. | |
| 6,198,434 | B1 | 3/2001 | Martek et al. | |
| 6,211,841 | B1 | 4/2001 | Smith et al. | |
| 6,225,950 | B1 | 5/2001 | Johansson et al. | |
| 6,351,237 | B1 | 2/2002 | Martek et al. | |
| 6,388,622 | B1 | 5/2002 | Jennetti et al. | |
| 6,583,760 | B2 | 6/2003 | Martek et al. | |
| 6,745,051 | B1 | 6/2004 | Bassirat | |
| 6,791,507 | B2 | 9/2004 | Johansson et al. | |
| 6,816,124 | B2 | 11/2004 | Tillery | |
| 6,900,775 | B2 | 5/2005 | Shapira | |
| 6,930,651 | B2 * | 8/2005 | Gottl et al. | 343/872 |
| 6,933,905 | B2 * | 8/2005 | Ippolito | 343/797 |
| 6,937,206 | B2 | 8/2005 | Puente Baliarda et al. | |
| 7,230,570 | B2 | 6/2007 | Thomas et al. | |
| 7,272,364 | B2 | 9/2007 | Frank et al. | |
| 7,277,731 | B2 | 10/2007 | Stratis et al. | |
| 7,308,270 | B2 | 12/2007 | Lastinger et al. | |
| 7,420,507 | B2 | 9/2008 | Thomas et al. | |
| 7,433,713 | B2 | 10/2008 | Haskell et al. | |

(Continued)

FOREIGN PATENT DOCUMENTS

| | | |
|---|---|---|
| JP | 6-196927 A | 7/1994 |
| JP | 2002-135047 A | 5/2002 |

(Continued)

OTHER PUBLICATIONS

Office Action dated May 13, 2013, in U.S. Appl. No. 12/659,254.

(Continued)

*Primary Examiner* — Huedung Mancuso
(74) *Attorney, Agent, or Firm* — McGinn IP Law Group, PLLC

(57) ABSTRACT

A mobile communication base station antenna has a plurality of array antenna blocks. Each of the array antenna blocks has a plurality of antenna element pairs. Each of the antenna element pairs has a plurality of antenna elements that are disposed to be orthogonal to each other. Tilt angles in the vertical plane of the respective array antenna blocks are different from each other.

15 Claims, 9 Drawing Sheets

(56) References Cited

U.S. PATENT DOCUMENTS

| | | | | |
|---|---|---|---|---|
| 7,538,740 | B2 * | 5/2009 | Korisch et al. | 343/844 |
| 7,616,618 | B2 * | 11/2009 | Kumar et al. | 370/342 |
| 7,663,544 | B2 * | 2/2010 | Thomas et al. | 342/361 |
| 7,751,372 | B2 | 7/2010 | Monsen | |
| 7,808,443 | B2 | 10/2010 | Lindmark et al. | |
| 7,965,993 | B2 | 6/2011 | Lindgren | |
| 8,059,553 | B2 | 11/2011 | Leung et al. | |
| 8,077,111 | B2 | 12/2011 | Derneryd et al. | |
| 8,165,095 | B2 | 4/2012 | Stratis et al. | |
| 8,165,637 | B2 | 4/2012 | Park et al. | |
| 8,185,162 | B2 | 5/2012 | Haskell et al. | |
| 8,368,609 | B2 | 2/2013 | Morrow et al. | |
| 8,422,540 | B1 | 4/2013 | Negus et al. | |
| 8,467,363 | B2 | 6/2013 | Lea et al. | |
| 2002/0011954 | A1 | 1/2002 | Judd et al. | |
| 2002/0021246 | A1 | 2/2002 | Martek et al. | |
| 2002/0173342 | A1 | 11/2002 | Kanamaluru et al. | |
| 2003/0073463 | A1 | 4/2003 | Shapira | |
| 2004/0066333 | A1 | 4/2004 | Judd et al. | |
| 2004/0127174 | A1 | 7/2004 | Frank et al. | |
| 2004/0145526 | A1 | 7/2004 | Puente Baliarda et al. | |
| 2004/0157645 | A1 | 8/2004 | Smith et al. | |
| 2004/0201543 | A1 * | 10/2004 | Gottl et al. | 343/912 |
| 2004/0209572 | A1 | 10/2004 | Thomas | |
| 2005/0101352 | A1 | 5/2005 | Logothetis et al. | |
| 2005/0250453 | A1 | 11/2005 | Lastinger et al. | |
| 2005/0282553 | A1 | 12/2005 | Lastinger et al. | |
| 2007/0030208 | A1 * | 2/2007 | Linehan | 343/757 |
| 2007/0049347 | A1 | 3/2007 | Jin et al. | |
| 2007/0080886 | A1 | 4/2007 | Thomas et al. | |
| 2007/0147251 | A1 | 6/2007 | Monsen | |
| 2007/0285312 | A1 | 12/2007 | Gao et al. | |
| 2009/0034448 | A1 | 2/2009 | Miller et al. | |
| 2009/0052411 | A1 | 2/2009 | Leung et al. | |
| 2009/0289864 | A1 | 11/2009 | Derneryd et al. | |
| 2010/0007573 | A1 | 1/2010 | Kuramoto et al. | |
| 2010/0066634 | A1 | 3/2010 | Derneryd et al. | |
| 2010/0097286 | A1 | 4/2010 | Morrow et al. | |
| 2010/0225552 | A1 | 9/2010 | Shimizu et al. | |
| 2010/0227646 | A1 | 9/2010 | Ogawa et al. | |
| 2010/0283705 | A1 | 11/2010 | Achour et al. | |
| 2011/0199992 | A1 | 8/2011 | Barker et al. | |
| 2012/0280878 | A1 | 11/2012 | Timofeev | |
| 2013/0002505 | A1 | 1/2013 | Teillet et al. | |
| 2013/0009839 | A1 | 1/2013 | Nghiem et al. | |

FOREIGN PATENT DOCUMENTS

| | | |
|---|---|---|
| JP | 2004-32392 | 1/2004 |
| JP | 2004-266600 | 9/2004 |
| JP | 2005-203841 | 7/2005 |
| JP | 2008-523708 A | 7/2008 |
| WO | WO 2008/063111 A1 | 5/2008 |

OTHER PUBLICATIONS

Japanese Office Action dated May 21, 2013 with English translation thereof.

Office Action dated Aug. 30, 2013, in U.S. Appl. No. 12/659,254.

* cited by examiner

MOBILE COMMUNICATION BASE STATION ANTENNA

The present application is based on Japanese Patent Application No. 2009-049764 filed on Mar. 3, 2009, the entire contents of which are incorporated herein by reference.

BACKGROUND OF THE INVENTION

1. Field of the Invention

The present invention relates to a dual-polarized antenna and an array antenna, more particularly, to a mobile communication base station antenna for realizing a Space Division Multiple Access (SDMA).

2. Related Art

In general, conventional mobile communication base station antenna has a sharp vertical plane directivity as shown in FIG. 7, so as to suppress interference to other cells. Referring to FIG. 7, in a mobile communication base station antenna 420, a main beam direction 422 of the antenna 420 provides a tilt angle 421 in the vertical plane with respect to a horizontal direction.

In the mobile communications, particularly, in portable phone communications, MIMO (Multiple Input Multiple Output) communication becomes popular. In the MIMO communication, data transmission efficiency can be enhanced by employing plural antenna as transmitting antenna and receiving antenna, respectively. In comparison with communication speed in the case of using one transmitting antenna and one receiving antenna, communication speed in the case of using two transmitting antennas and two receiving antennas is theoretically double, and communication speed in the case of using four transmitting antennas and four receiving antennas is theoretically four times.

In the MIMO communication, correlation of signals from respective transmitting antennas to respective receiving antennas becomes important. In particular, a channel capacity of the transmitting antenna is influenced by a correlation coefficient between the respective transmitting antennas, and a channel capacity of the receiving antenna is influenced by a correlation coefficient between the respective receiving antennas. For example, in the 4×4 MIMO communication using four transmitting antennas and four receiving, antennas, when there is "no correlation", namely, the correlation coefficient is substantially zero (0), between the respective antennas, the communication speed is close to 4 times which is theoretically established. On the other hand, when the correlation coefficient is substantially 1, the effect of the MIMO communication cannot be expected. In practical use, it is preferable that the correlation coefficient between the antennas is 0.7 or less.

For example, Japanese Patent Laid-Open No. 2005-203841 (JP-A 2005-203841) discloses a conventional polarization diversity antenna element used in a mobile phone base station antenna.

So as to decrease the correlation coefficient, it is sufficient to spatially or electrically divide (separate) the antenna. By way of example only, the conventional polarization diversity antenna element used in the mobile phone base station antenna disclosed by JP-A 2005-203841 is a two-system antenna which is divided by polarization. Therefore, if such an antenna is used for an array antenna, it can be converted into a base station antenna for 2×2 MIMO communication.

By way of example only, for the case of 4×4 MIMO communication, if a distance between two antennas is increased, namely, the two antennas are distant from each other, the correlation coefficient will be decreased in accordance with the increase in distance. Therefore, referring to FIGS. 8 and 9, it is requested that a distance between two polarization diversity array antennas 505, 505 that are juxtaposed (FIG. 8) or vertically arranged in a column (FIG. 9) should be increased as much as possible. However, there is another request inconsistent with the former request, namely, it is also requested that the distance between the two polarization diversity array antennas 505, 505 should be decreased as much as possible, since a volume (space) required for antenna installation increases when the distance between the two antennas is increased too much.

SUMMARY OF THE INVENTION

Therefore, an object of the present invention is to provide a mobile communication base station antenna, in which the correlation coefficient between respective array antenna blocks is decreased by changing a tilt angle in the vertical plane of the array antenna block.

According to a feature of the invention, a mobile communication base station antenna comprises:

a plurality of array antenna blocks, each of the array antenna blocks comprising a plurality of antenna element pairs, each of the antenna element pair comprising antenna elements that are disposed to be orthogonal to each other, wherein tilt angles in a vertical plane of the respective array antenna blocks are different from each other.

In the mobile communication base station antenna, the array antenna blocks may be vertically arranged in the vertical plane, and the tilt angles in the vertical plane of the respective array antenna blocks may be determined such that a correlation coefficient between the respective array antenna blocks is 0.7 or less.

In the mobile communication base station antenna, the tilt angles in the vertical plane of the respective array antenna blocks may be arbitrarily set by mechanically changing a direction of each of the array antenna blocks.

In the mobile communication base station antenna, the tilt angles in the vertical plane of the respective array antenna blocks may be arbitrarily set by shifting a signal phase by a phase shifter.

In the mobile communication base station antenna, the phase shifter may be a fixed phase shifter in which a shift amount of the signal phase is fixed.

Alternatively, in the mobile communication base station antenna, the phase shifter may be a variable phase shifter in which a shift amount of the signal phase is freely determined.

ADVANTAGES OF THE INVENTION

The present invention provides following excellent effects.

(1) The correlation coefficient between the respective array antenna blocks can be decreased.

(2) The increase in volume (space) required for antenna installation can be suppressed.

BRIEF DESCRIPTION OF THE DRAWINGS

Next, the mobile communication base station antenna in embodiments according to the invention will be explained in conjunction with appended drawings, wherein:

FIGS. 2A and 2B are explanatory diagrams of a structure of the array antenna block in the mobile communication base station antenna in the embodiment according to the invention, wherein FIG. 2A is a front view of the array antenna block and FIG. 2B is a side view of the array antenna block;

FIGS. 4A and 4B are explanatory diagrams showing an adjustment of the antenna correlation coefficient by changing a distance between the array antenna blocks in the mobile communication base station antenna shown in FIG. 1, in which FIG. 4A shows a case where the antenna correlation coefficient is large and FIG. 4B shows a case where the antenna correlation coefficient is small;

DETAILED DESCRIPTION OF THE EMBODIMENT

Next, the embodiment according to the present invention will be explained below in more detail in conjunction with appended drawings.

(Points of the Invention)

In the present invention, tilts angle in the vertical plane of respective array antenna blocks are set to be different from each other in a base station array antenna having a sharp directivity in the vertical plane, in order to provide a difference in the directivities of the respective array antenna blocks. In addition, there is an antenna in which the tilt angle in the vertical plane is fixed and an antenna in which the tilt angle in the vertical plane is variable.

The tilt angle in the vertical plane may be set to be an arbitrary angle by controlling a phase for feeding a power to each antenna element.

Embodiment

Next, a mobile communication base station antenna in the embodiment according to the invention will be explained below in conjunction with appended drawings.

(Total Structure of Mobile Communication Base Station Antenna)

Figure 1:
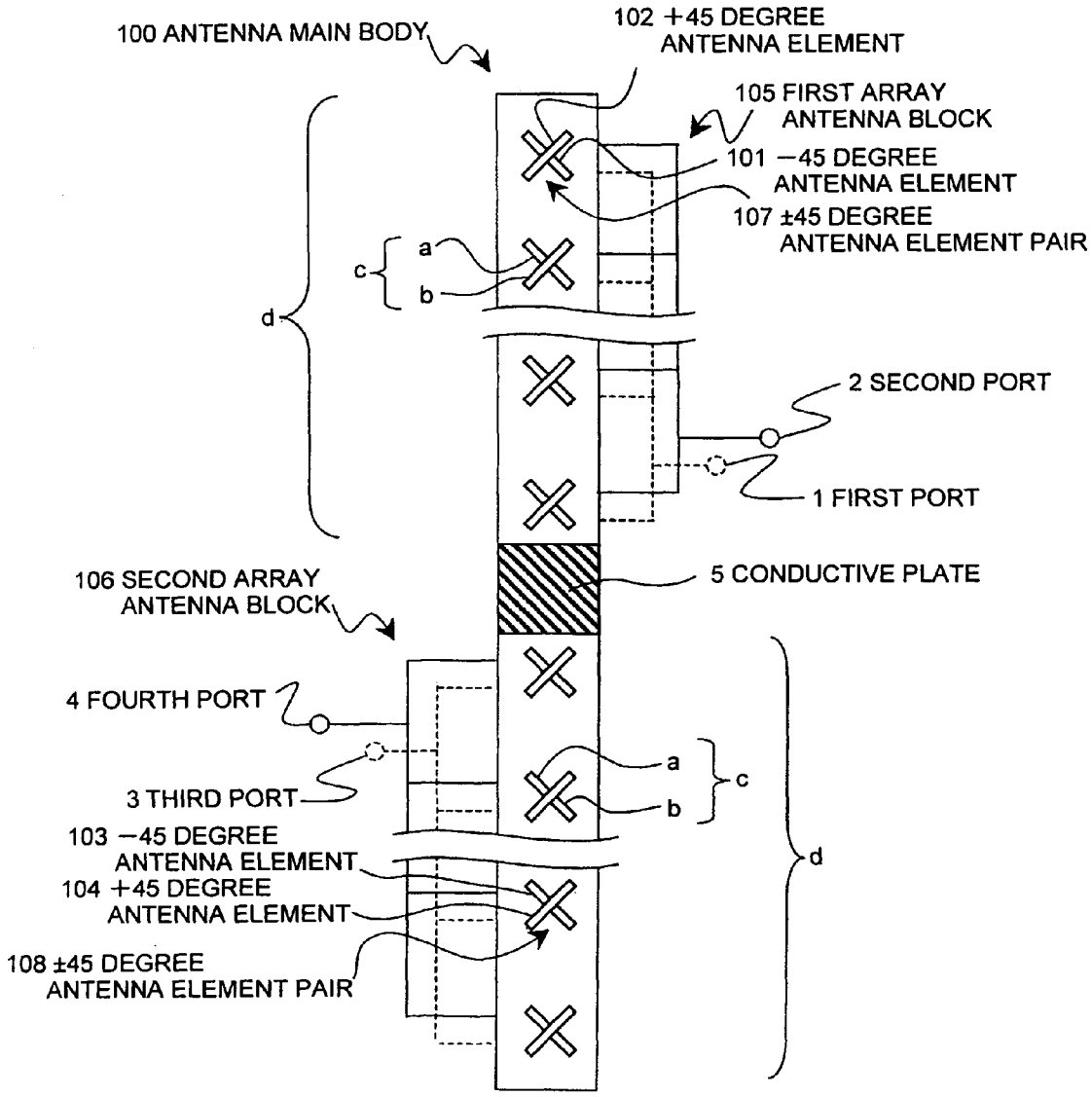
FIG. 1 is a schematic diagram showing an elevational view of a mobile communication base station antenna in one embodiment according to the invention.

FIG. 1 is a schematic diagram showing an elevational view of a mobile communication base station antenna 100 in one embodiment according to the invention.

Referring to FIG. 1, a mobile communication base station antenna (antenna main body) 100 of the present invention is a mobile communication base station antenna comprising a plurality of array antenna blocks d, each of which comprises a plurality of antenna element pairs c, each of which comprises a plurality of antenna elements a, b that are disposed to be orthogonal to each other, in which tilt angles in the vertical plane of the respective array antenna blocks d are different from each other.

The plurality of array antenna blocks d (a first array antenna block 105 and a second array antenna block 106) are connected with each other via a conductive plate 5. The conductive plate 5 provides the plurality of array antenna blocks d connected to each other via the conductive plate 5 with a common ground potential (GND potential). The plurality of array antenna blocks d connected to each other via conductive plate 5 are configured to be disposed with a predetermined distance in a vertical direction.

(Tilt Angle in the Vertical Plane)

Figure 7:
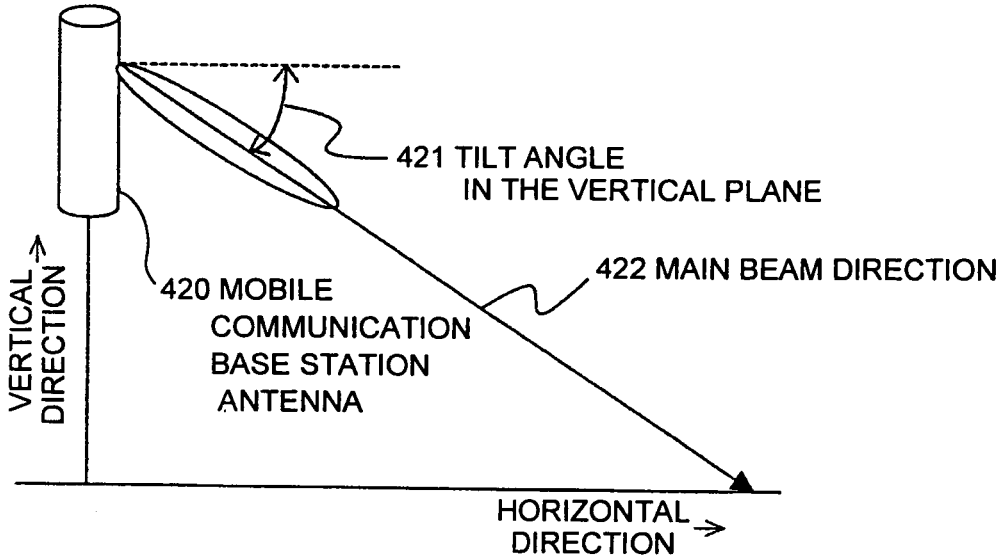
FIG. 7 is an explanatory diagram showing a side view of a mobile phone base station antenna, in which directivity in the vertical plane is shown.
Figure 8:
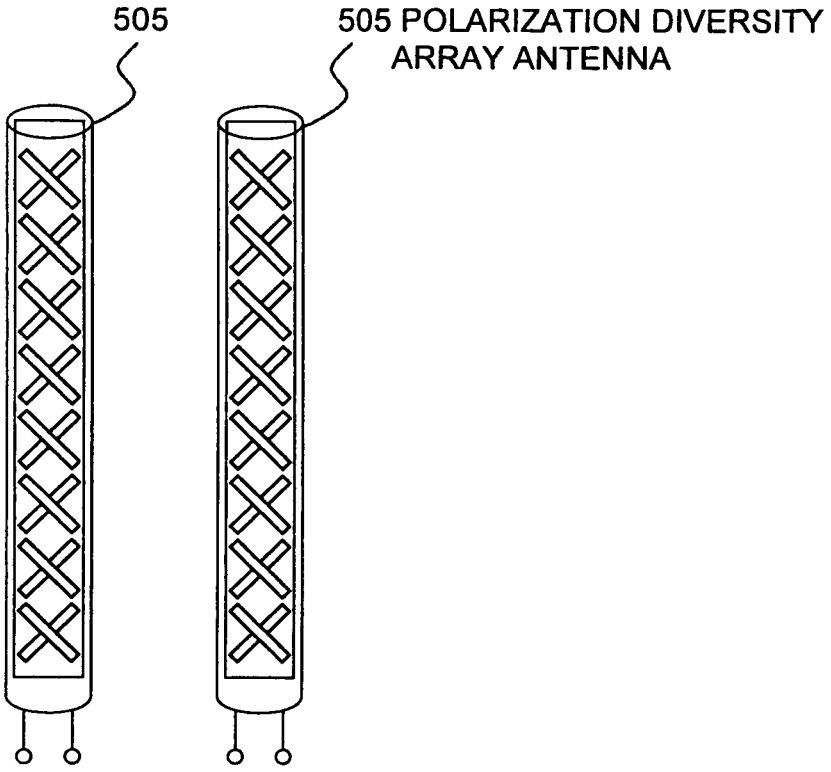
FIG.8 PRIOR ART
FIG. 8 is a schematic diagram showing an elevational view of a conventional 4×4 MIMO communication antenna installation, in which polarization diversity array antennas are juxtaposed with each other.
Figure 9:
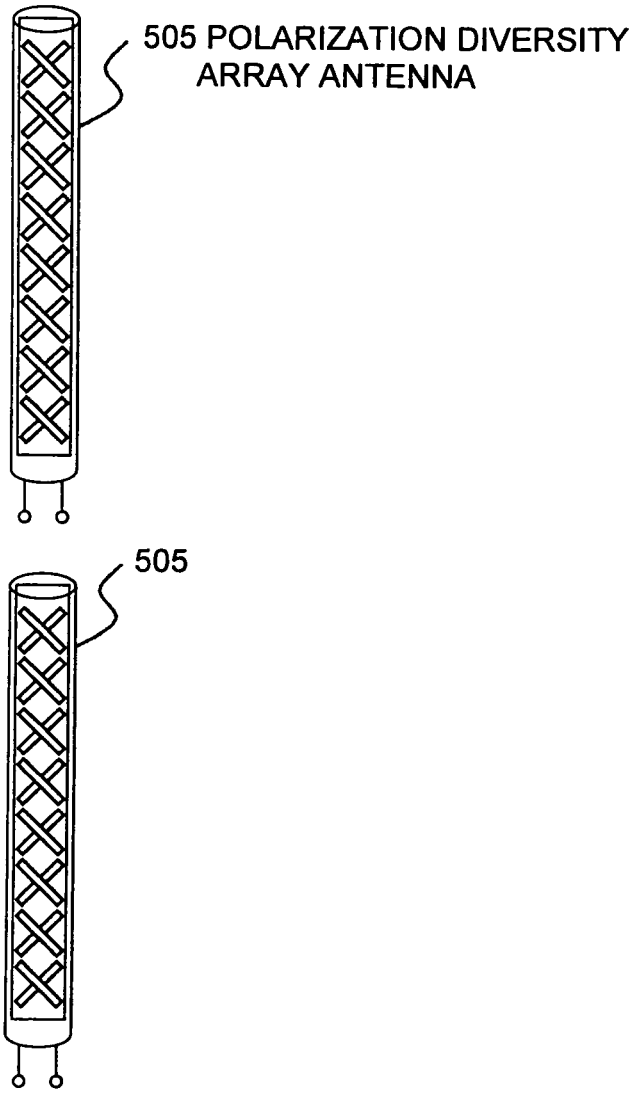
FIG.9 PRIOR ART
FIG. 9 is a schematic diagram showing an elevational view of a conventional 4×4 MIMO communication antenna installation, in which the polarization diversity array antennas are vertically arranged in one column.

The tilt angle in the vertical plane of each of the array antenna blocks d is defined as an inclination angle in the vertical plane of a main beam emitted from the array antenna block d with respect to a horizontal direction, as explained with referring to FIG. 7.

(Detailed Structure of the Mobile Communication Base Station Antenna)

The mobile communication base station antenna 100 in the embodiment according to the invention shown in FIG. 1 has a configuration, in which array antenna blocks of polarization diversity antenna, namely the plurality of the array antenna blocks (the first array antenna block 105 and the second array antenna block 106) are combined with each other and vertically arranged in the vertical plane. In this embodiment, a combination of polarization diversity elements is a combination of +45 degree polarization diversity and −45 degree polarization diversity.

The mobile communication base station antenna (antenna main body) 100 comprises the first array antenna block 105 comprising an antenna element (−45 degree antenna element) 101 connected to a first port 1, and an antenna element (+45 degree antenna element) 102 connected to a second port 2, and a second array antenna block 106 comprising an antenna element (−45 degree antenna element) 103 connected to a third port 3 and an antenna element (+45 degree antenna element) 104 connected to a fourth port 4.

Herein, the first port 1 and the third port 3 are ports (feeding points) electrically connected to the −45 degree antenna element 101 and the −45 degree antenna element 103, respectively. On the other hand, the second port 2 and the fourth port 4 are ports (feeding points) electrically connected to the +45 degree antenna element 102 and the +45 degree antenna element 104, respectively.

The first array antenna block 105 is an array antenna block disposed in an upper section, and the second array antenna block 106 is another array antenna block arranged in a lower section.

In the first array antenna block 105, the −45 degree antenna element 101 and the +45 degree antenna element 102 are arranged to intersect with each other to provide a ±45 degree antenna element pair 107. Similarly, in the second array antenna block 106, the −45 degree antenna element 103 and the +45 degree antenna element 104 are arranged to intersect with each other to provide a ±45 degree antenna element pair 108.

(Structure of the Array Antenna Block)

Figure 2A:
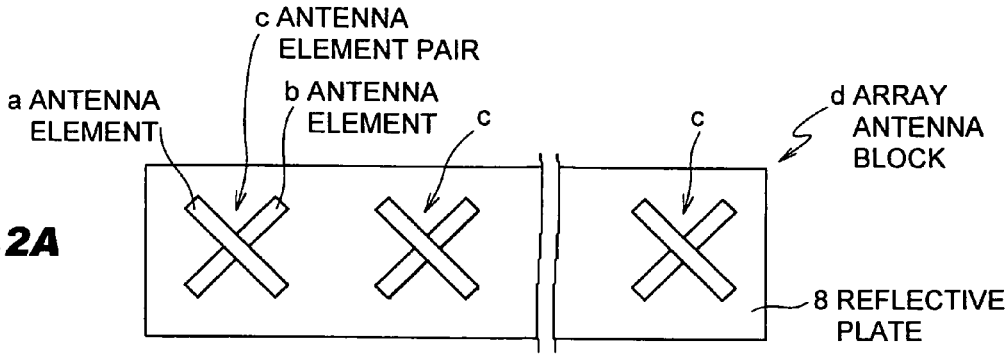
Figure 2B:
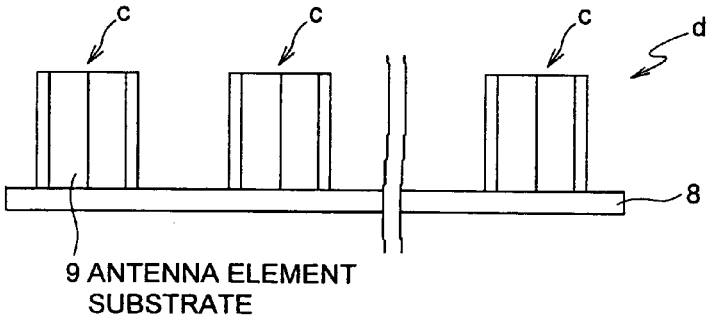

FIGS. 2A and 2B are explanatory diagrams of a structure of the array antenna block d in the mobile communication base station antenna 100 in the embodiment according to the invention, wherein FIG. 2A is a front view of the array antenna block d and FIG. 2B is a side view of the array antenna block d.

Figure 3:
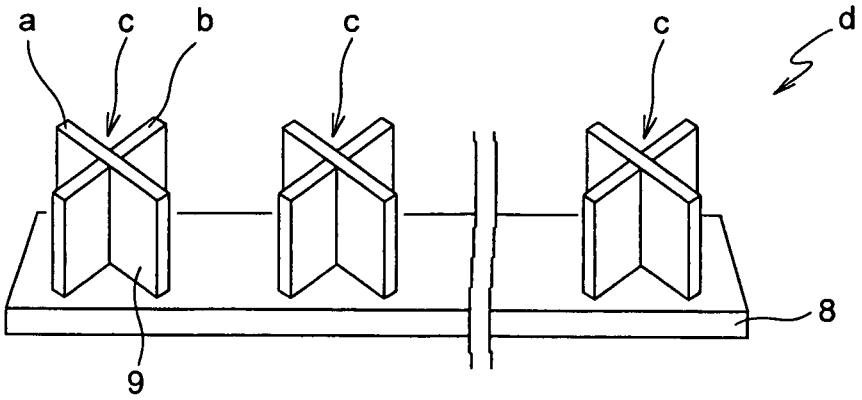
FIG. 3 is an explanatory diagram showing a perspective view of the array antenna block in the mobile communication base station antenna in the embodiment shown in FIGS. 2A and 2B.

FIG. 3 is an explanatory diagram showing a perspective view of the array antenna block d in the mobile communication base station antenna 100 in the embodiment shown in FIGS. 2A and 2B.

As shown in FIGS. 2A-2B and FIG. 3, the array antenna block d has a structure in which antenna element pairs c are disposed in the array shape along a longitudinal direction of a reflective plate 8. The antenna element pairs (±45 degree antenna element pairs in FIGS. 2A-2B and FIG. 3) c are construed by combining the antenna elements a, b to have a cross-shape in its cross sectional view. Each of the antenna elements a, b is construed by forming an antenna element pattern (not shown) comprising a metal, a combination of the metal and a dielectric material, or the like on a surface of an antenna element substrate 9. It is possible to transmit and receive electric waves as +45 degree polarized wave and −45 degree polarized wave in dual mode. The antenna elements a, b are respectively connected to different feeding points (not shown in FIGS. 2A-2B and FIG. 3) via feeding lines (not shown). For example, referring to FIG. 1, the antenna element a is connected to the first port 1 or the third port 3, and the antenna element b is connected to the second port 2 or the fourth port 4.

Further, in this embodiment, a half wave dipole antenna is used as the antenna elements a, b. In addition, half wave dipole antennas disclosed by Japanese Patent Laid-Open No. 2004-32392 (JP-A 2004-32392) and Japanese Patent Laid-Open No. 2004-266600 (JP-A 2004-266600) may be used as the half wave dipole antenna in this embodiment. However, the antenna elements a, b are not limited to the half wave dipole antenna, and a patch antenna and other polarized wave diversity antenna elements may be used.

The combination of the antenna element (−45 degree antenna element) 101 connected to the first port 1 and the antenna element (+45 degree antenna element) 102 connected to the second port 2 may be used as an array antenna for 2×2 MIMO communication. In similar manner, the combination of the antenna element (−45 degree antenna element) 103 connected to the third port 3 and the antenna element (+45 degree antenna element) 104 connected to the fourth port 4 may be used as an array antenna for 2×2 MIMO communication.

However, it is necessary to provide a sufficient distance, which is about several times of a wavelength to be used, between the two array antenna blocks (the first array antenna block 105 and the second array antenna block 106), in order to decrease the correlation coefficient between the first array antenna block 105 including the antenna element (−45 degree antenna element 101) connected to the first port 1 and the second array antenna block 106 including the antenna element (−45 degree antenna element 103) connected to the third port 3 that have the same polarization characteristics. In that case, an entire length of the antenna main body 100 is increased.

Figure 4A:
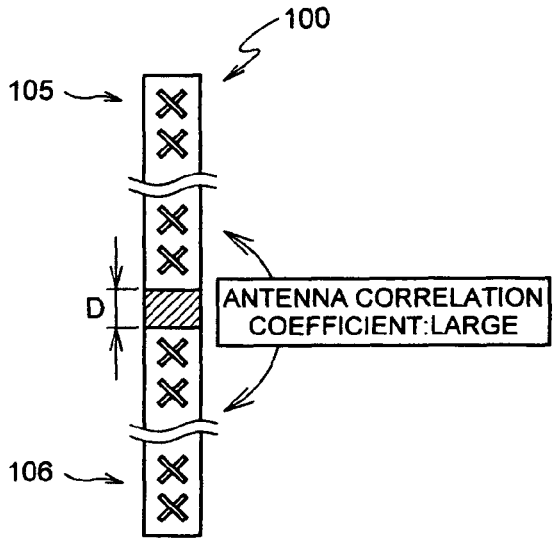
Figure 4B:
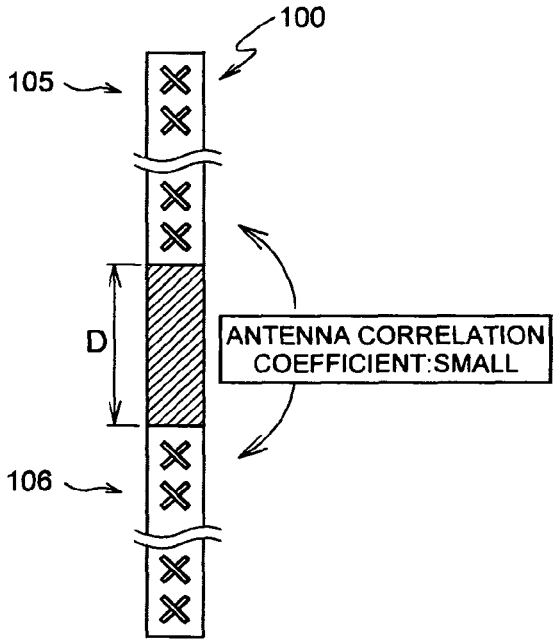

FIGS. 4A and 4B are explanatory diagrams showing an adjustment of the antenna correlation coefficient by changing a distance between the array antenna blocks (namely, the first array antenna block 105 and the second array antenna block 106) in the mobile communication base station antenna 100 shown in FIG. 1, in which FIG. 4A shows a case where the antenna correlation coefficient is large and FIG. 4B shows a case where the antenna correlation coefficient is small.

As shown in FIGS. 4A and 4B, the antenna correlation coefficient can be adjusted by changing a distance (location interval) D between the array antenna blocks, i.e. between the first array antenna block 105 and the second array antenna block 106.

As shown in FIG. 4A, when the distance D between the first array antenna block 105 and the second array antenna block 106 is small, the antenna correlation coefficient is unfavorably increased. Therefore, it is necessary to increase the distance D between the first array antenna block 105 and the second array antenna block 106, so as to decrease the antenna correlation coefficient. However, as shown in FIG. 4B, when the distance D between the first array antenna block 105 and the second array antenna block 106 is large, an entire length (a dimension in the vertical direction) of the mobile communication base station antenna 100 is increased.

(Difference in the Tilt Angles in the Vertical Plane)

Figure 5:
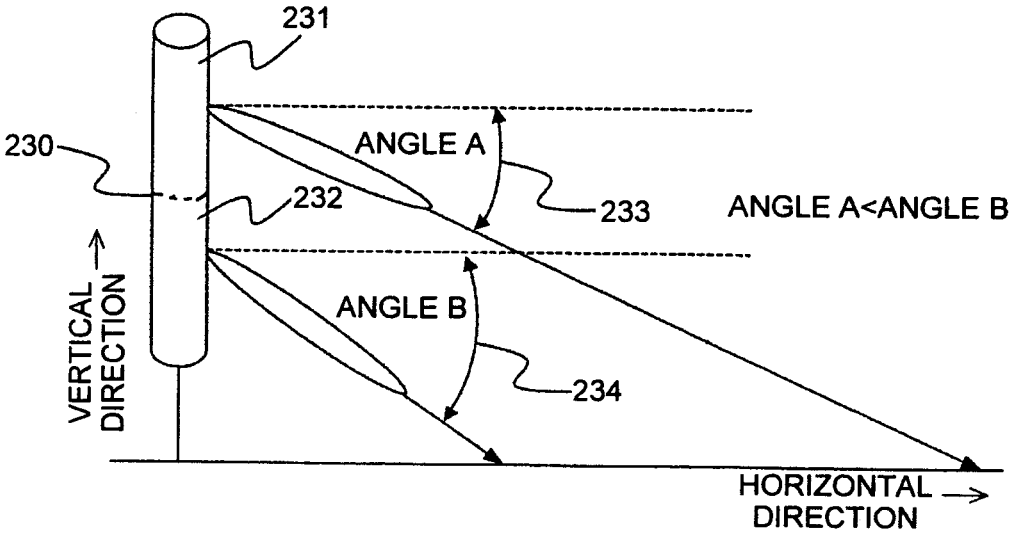
FIG. 5 is an explanatory diagram showing a side view of the mobile communication base station antenna, in which directivity in the vertical plane is shown.

FIG. 5 is an explanatory diagram showing a side view of the mobile communication base station antenna 100, in which directivity in the vertical plane is shown.

Referring to FIG. 5, in an MIMO base station antenna 230 which is a mobile communication base station antenna of the present invention, a tilt angle 233 in the vertical plane in an antenna element (−45 degree antenna element) 231 connected to the first port 1 included in a first array antenna block is set as an angle A, and a tilt angle 234 in the vertical plane in an antenna element (−45 degree antenna element) 232 connected to the third port 3 included in a first array antenna block is set as an angle B. Herein, the angle A (degree) is smaller than the angle B (degree) (A<B).

In this way, a difference is provided between the angle A of the tilt angle 233 in the vertical plane of the antenna element 231 connected to the first port 1 and the angle B of the tilt angle 234 of the antenna element 232 connected to the third port 3 that have the same polarization characteristics (−45 degree polarization characteristic). For example, in the embodiment shown in FIG. 5, the angle A of the tilt angle 233 in the vertical plane of the antenna element 231 connected to the first port 1 is 3 degrees, while the angle B of the tilt angle 234 of the antenna element 232 connected to the third port 3 is 6 degrees.

As described above, since the mobile communication base station antenna has the sharp directivity in the vertical plane, when the tilt angle in the vertical plane is changed, a three-dimensional directivity, particularly a directivity of the main beam varies greatly. Therefore, overlap of the directivities of the respective array antenna blocks can be reduced by providing a difference in the tilt angles in the vertical plane, thereby decreasing the correlation coefficient.

The tilt angle in the vertical plane of the antenna element included in the array antenna block can be mechanically changed by changing a direction of the array antenna block. In addition, the tilt angle in the vertical plane of the antenna element included in the array antenna block can be arbitrarily changed by changing a signal phase by a phase shifter (not shown). The phase shifter may be a fixed phase shifter in which a shift amount of signal phase is fixed to a constant value. The phase shifter may be a variable (tunable) phase shifter in which the shift amount of the signal phase can be set freely.

This operation of decreasing the correlation coefficient can be conducted in the array antenna block comprising the antenna element connected to the second port 2 and the antenna element connected to the fourth port 4 that have the same polarization characteristics (+45 degree polarization characteristic), by providing a difference between the tilt angles in the vertical plane.

In addition, this operation of decreasing the correlation coefficient can be also conducted between the antenna elements having different polarization characteristics.

(Relation Between the Antenna Correlation Coefficient and the Tilt Angle in the Vertical Plane)

Figure 6A:
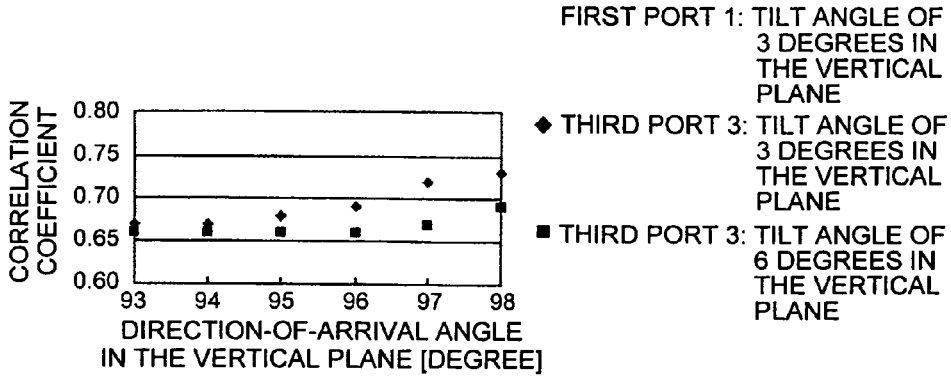
FIG. 6A is a graph showing a relationship of the antenna correlation coefficient between a first array antenna block including an antenna element connected to a first port 1 and a second array antenna block including an antenna element connected to a third port 3 with respect to a direction-of-arrival angle in the vertical plane that is theoretically calculated according to the invention.

FIG. 6A is a graph showing a relationship of the antenna correlation coefficient between the first array antenna block 105 including the antenna element connected to the first port 1 and the second array antenna block 106 including the antenna element connected to the third port 3 with respect to the direction-of-arrival angle in the vertical plane that is theoretically calculated according to the invention.

Figure 6B:
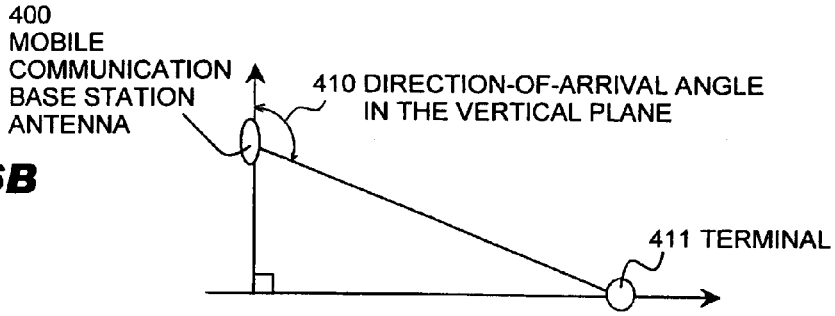
FIG. 6B is an explanatory diagram showing a side view of a mobile communication base station antenna, in which a direction-of-arrival angle in the vertical plane is defined.

FIG. 6B is an explanatory diagram showing a side view of a mobile communication base station antenna 400, in which a direction-of-arrival angle 410 in the vertical plane with respect to a terminal 411 is defined. The "direction-of-arrival (DOA)" angle is an obtuse angle made by the vertical direction and a direction-of-arrival in the vertical plane of a beam coming from the terminal 411 to the mobile communication base station antenna 400.

Referring to FIG. 6A, a tilt angle of 3 degrees in the vertical plane of the antenna element (−45 degree antenna element) 231 connected to the first port 1 included in the first array antenna block is provided as a reference value. The antenna correlation coefficient with the second array antenna block is shown by using the direction-of-arrival angle as a parameter for the case in which the tilt angle in the vertical plane of the antenna element (−45 degree antenna element) 232 connected to the third port 3 in the same polarization plane is 3 degrees, and for the case in which the tilt angle in the vertical plane of the antenna element (−45 degree antenna element) 232 connected to the third port 3 in the same polarization plane is 6 degrees.

More concretely, the correlation coefficient was calculated by assuming that an installation height of the mobile communication base station antenna 400 (100) was 50 m. For this case, a distance (m) between the mobile communication base station antenna 400 and the terminal 411 was 954 m for the DOA angle of 93°, 715 m for the DOA angle of 94°, 572 m for the DOA angle of 95°, 476 m for the DOA angle of 96°, 407 m for the DOA angle of 97°, and 356 m for the DOA angle of 98°. In addition, the distance D between the first array antenna block 105 and the second array antenna block 106 is 100 mm.

Referring to FIG. 6A, it is clearly understood that the correlation coefficient between the first array antenna block 105 including the antenna element connected to the first port 1 and the second array antenna block 106 including the antenna element connected to the third port 3 is 0.7 or less which is a target value in which the effect of the MIMO can be expected, when the difference is provided between the tilt angles in the vertical plane and the DOA angle is 96 degrees or less.

Other Embodiments

As other embodiments of the present invention, following arrangement examples and combinations of the antenna elements may be used.

If the combination of the polarization diversity elements is used, the present invention is not limited to the combination of the +45 degree polarization diversity element and the −45 degree polarization diversity element as shown in FIG. 1. The combination of a vertical polarization diversity element and a horizontal polarization diversity element may be used. The combination of the vertical polarization diversity element and the horizontal polarization diversity element may be combined with the combination of the +45 degree polarization diversity element and the −45 degree polarization diversity element.

If a combination of elements emitting linear polarization, an element configuration is not limited.

In the aforementioned embodiments, when the respective array antenna blocks are vertically arranged in the vertical plane, the array antenna blocks are basically arranged along the same axis. Inasmuch as the embodiments do not deviate from a scope of the technical concept of the present invention, a plurality of array antenna blocks may be vertically arranged in the vertical plane such that axes of the respective array antenna blocks are shifted in backward and forward direction (left and right direction), namely the axes of the respective array antenna blocks are parallel with each other.

According to the present invention, the directivities of the respective array antenna blocks can be changed by changing the tilt angles in the vertical plane in the upper and lower array antenna blocks, thereby decreasing the correlation coefficient between the upper and lower array antenna blocks. Further, a space multiplexing effect of MIMO can be enhanced by decreasing the correlation coefficient between the respective array antenna blocks, thereby enhancing the data transmission efficiency. Still further, it is possible to suppress the increase in volume (space) required for antenna installation.

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. A mobile communication base station antenna, comprising:

a plurality of array antenna blocks, each of the array antenna blocks comprising a plurality of antenna element pairs, each of the antenna element pairs comprising antenna elements that are disposed to be orthogonal to each other, wherein tilt angles in a vertical plane of respective array antenna blocks are different from each other, wherein the array antenna blocks are arranged along a same axis in a vertical direction in the vertical plane, wherein said each of the array antenna blocks has same polarization characteristics, wherein a Multiple Input Multiple Output (MIMO) communication is carried out by the array antenna blocks, wherein the array antenna blocks are provided with a common grounding potential, and wherein the array antenna blocks are connected via a conductive plate.

2. The mobile communication base station antenna according to claim 1, wherein the tilt angles in the vertical plane of the respective array antenna blocks are determined such that a correlation coefficient between the respective array antenna blocks is 0.7 or less.

3. The mobile communication base station antenna according to claim 1, wherein the tilt angles in the vertical plane of the respective array antenna blocks are arbitrarily set by mechanically changing a direction of each of the array antenna blocks.

4. The mobile communication base station antenna according to claim 1, wherein the tilt angles in the vertical plane of the respective array antenna blocks are arbitrarily set by shifting a signal phase by a phase shifter.

5. The mobile communication base station antenna according to claim 4, wherein the phase shifter comprises a fixed phase shifter in which a shift amount of the signal phase is fixed.

6. The mobile communication base station antenna according to claim 4, wherein the phase shifter comprises a variable phase shifter in which a shift amount of the signal phase is freely determined.

7. The mobile communication base station antenna according to claim 1, further comprising:

a first feeding port electrically connected to one of the antenna elements of said each of the antenna element pairs; and a second feeding port electrically connected to another one of the antenna elements of said each of the antenna element pairs.

8. The mobile communication base station antenna according to claim 7, wherein a combination of the one of the antenna elements and said another one of the antenna elements carries out the MIMO communication.

9. The mobile communication base station antenna according to claim 1, wherein the polarization characteristics comprise a degree of polarization.

10. The mobile communication base station antenna according to claim 1, wherein a tilt angle of one of the array antenna blocks located in an upper part of the mobile communication base station antenna is less than a tilt angle of another one of the array antenna blocks located in a lower part of the mobile communication base station antenna.

11. The mobile communication base station antenna according to claim 1, wherein the plurality of array antenna blocks is arranged linearly.

12. The mobile communication base station antenna according to claim 1, wherein the plurality of array antenna blocks is arranged in a line such that centers of the antenna element pairs of one of the array antenna blocks and centers of the antenna element pairs of another one of the array antenna blocks are located on the line.

13. A mobile communication base station antenna, comprising:

a plurality of array antenna blocks, each of the array antenna blocks comprising a plurality of antenna element pairs each of the antenna element pairs comprising antenna elements that are disposed to be orthogonal to each other, wherein tilt angles in a vertical plane of respective array antenna blocks are different from each other, wherein the array antenna blocks are arranged along a same axis in a vertical direction in the vertical plane, wherein said each of the array antenna blocks has same polarization characteristics, and wherein a Multiple Input Multiple Output (MIMO) communication is carried out by the array antenna blocks; and a conductive plate that connects an upper part of the array antenna blocks to a lower part of the array antenna blocks.

14. The mobile communication base station antenna according to claim 13, wherein the upper part of the array antenna blocks is connected to the lower part of the array antenna blocks via the conductive plate with a common ground potential.

15. The mobile communication base station antenna according to claim 13, wherein tilt angles of the array antenna blocks located in the upper part of the array antenna blocks are less than tilt angles of the array antenna blocks located in the lower part of the array antenna blocks.

* * * * *